US009440720B1

(12) United States Patent
Sawyer, Jr.

(10) Patent No.: US 9,440,720 B1
(45) Date of Patent: Sep. 13, 2016

(54) TOMMY POWER PADDLE

(71) Applicant: Thomas Kidder Sawyer, Jr., Martinsville, MO (US)

(72) Inventor: Thomas Kidder Sawyer, Jr., Martinsville, MO (US)

( * ) Notice: Subject to any disclaimer, the term of this patent is extended or adjusted under 35 U.S.C. 154(b) by 8 days.

(21) Appl. No.: 14/545,004

(22) Filed: Mar. 16, 2015

(51) Int. Cl.
*B63H 16/04* (2006.01)
*B63H 16/08* (2006.01)
*B63H 1/14* (2006.01)

(52) U.S. Cl.
CPC ..... *B63H 16/04* (2013.01); *B63H 1/14* (2013.01); *B63H 16/08* (2013.01)

(58) Field of Classification Search
CPC ..... B63H 16/04; B63H 16/08; B63H 1/14
See application file for complete search history.

(56) References Cited

U.S. PATENT DOCUMENTS 1,512,391 A * 10/1924 Abraham ..... B63H 16/04 416/120
7,140,931 B2 * 11/2006 Norman ..... B63H 5/14 440/67
9,352,816 B1 * 5/2016 Sawyer, Jr. ..... B63H 16/04
2009/0176419 A1 * 7/2009 Banks ..... B63H 5/14 440/67
2011/0223816 A1 * 9/2011 Boukas ..... B63H 1/14 440/6

* cited by examiner

*Primary Examiner* — Stephen Avila

(57) ABSTRACT

A paddle device, where this principle described may be configured to accommodate canoe, kayak, paddle boards or any similar watercraft using a paddle type device. This paddle device comprises a shaft having a first end and a second end with a paddle-like blade having a proximal end and a distal end and coupled to the second end of the shaft. This paddle blade device is equipped with one or more multi-blade propellers that are mounted on the paddle blade. The multi-blade propeller or multi-blade propellers are driven by the pulling motion of the paddler or driven by the action of the natural water current the paddler is navigating. The propeller is designed to swivel so as to keep the propeller blade more in direct alignment with the force of the water driving it. This insures that the propeller is at the most efficient angle to help propel and control the watercraft. The propeller or propellers are protected with a lattice type guard on both sides of the paddle blade.

This paddle blade is also equipped with orifices devices through the paddle blade that have a center cone like shape. The larger orifice opening is on the pulling side of the paddle blade and the smaller water discharging orifice is on the opposite side. These orifice devices are made with a center rotating cone shape that has inner ribs and grooves and mounted in the orifice housing. This device also has a capability for the center rotating cone shape to swivel so as to keep the generated water force more in direct alignment with the force of the water driving it. In this manner the force of the water is increased through the paddle blade to give the water increased pressure to help propel the watercraft device the paddler is navigating. This force also lessens the amount of force required to pull the paddle through the water. The orifice rotating device is also protected with a lattice type guard on both sides of the paddle blade.

This paddle device can also be used in a reverse fashion by rotating the paddle blade 180 degrees so as to be used when navigating a watercraft with the water current in order to help stabilize the watercraft by using the force of the current against the propeller blades and the energy generated by the orifices to aid in controlling the watercraft.

7 Claims, 3 Drawing Sheets

TOMMY POWER PADDLE

BACKGROUND OF THE INVENTION

The typical canoe, kayak, paddle board or similar watercraft type paddle that includes a shaft having a first end and a second end and a paddle blade having a proximal end and a distal end and coupled to the second end of the shaft. These paddles are made from many various types of materials and with many varying shape shafts and paddle blade shapes and designs. (The kayak paddle typically has a paddle blade on both ends of the fixed center shaft. This invention also allows for the same propeller and or cone like orifices configuration that is applied to a single paddle blade device to also be applied on both ends of the kayak fixed shaft.)

The typical canoe, kayak, paddle board or similar watercraft type paddle blade is made with a flat face or slightly curved blade and of varying angles between the shaft and paddle blade and may be made of a solid composition material or made up of multiple parts made of various composition materials and even natural wood.

Typically water flow that is generated by pulling the paddle blade through the water travels to the edges of the paddle blade and is lost energy that could otherwise be used for a greater purpose to help propel the watercraft forward or control the watercraft when going with the water current.

There have been many designs over the years to improve the typical canoe, kayak, paddle board or similar watercraft type paddle, but none have attempted to use the force of the water pressure generated from pulling a paddle blade through the water as this invention attempts to do.

This invention offers a means of using or harnessing the kinetic energy used to pull the paddle blade through the water in order to gain force and also to reduce energy required to propel or navigate the watercraft forward and or to control the motion or direction of the watercraft.

By means of installing a multi-blade propeller or multiple propellers and cone like orifices on the canoe, kayak, paddle board or similar watercraft flat blade a means is then derived to control and harness the kinetic energy generated by pulling the canoe, kayak, paddle board or similar watercraft paddle blade through the water.

This device offers a means that requires less energy to operate a canoe, kayak, paddle board or similar watercraft. This style paddle also gives the paddler more control over the watercraft he is maneuvering through the water.

SUMMARY OF THE INVENTION

This invention of a canoe, kayak, paddle board or similar watercraft paddle device is an attempt to harness the kinetic energy generated while pulling a canoe, kayak, paddle board or similar watercraft paddle blade device through the water. This invention comprises a shaft having a first end and a second end and a paddle blade having a proximal end and a distal end and coupled to the second end of the shaft. The paddle blade of this invention is equipped with a multi-blade propeller or multiple multi-blade propellers and can also be equipped with cone shape orifices or any combination of the two.

The use of the multi-blade propeller or multiple multi-blade propellers and cone shaped orifices are to capture the kinetic energy generated while pulling a canoe, kayak, paddle board or similar watercraft paddle device through the water. The force or energy generated is transferred to the propeller blades and the water forced through the cone shaped orifices help propel the watercraft forward with less effort than a plain flat, curved or other type design surface paddle blade.

The canoe, kayak, paddle board or similar watercraft paddle device can be reversed 180 degrees so as to be used when the watercraft is going with the current to affect the watercraft to have more controlled movement and used as a control mechanism to help steer the watercraft due to the thrust of the multi-blade propeller or propellers and the water force generated from the cone shaped orifice devices.

BRIEF DESCRIPTION OF THE DRAWINGS

The attached drawings included in this presentation are to help further describe the embodiment of this invention. It is hoped the drawings will illustrate the heart of the invention and even go a step further in addressing the advantages of having a canoe or kayak paddle with a propeller blade or blades and orifices made into the paddle blade.

DETAILED DESCRIPTION OF THE PREFERRED EMBODIMENTS

Figure 1:
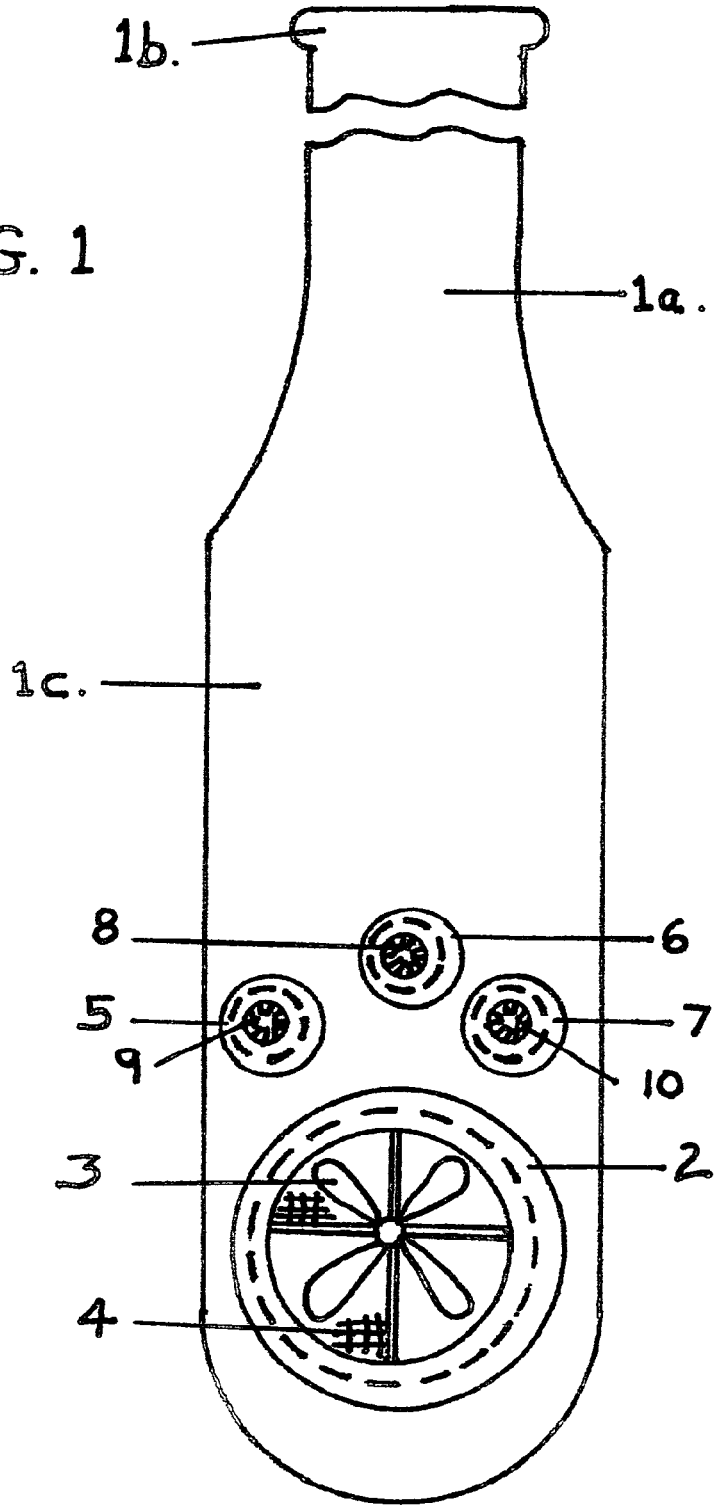
FIG. 1 illustrates a front perspective view of the canoe, kayak, paddle board or similar watercraft paddle blade device with a propeller housing assembly as well as several cone shaped orifice devices with the center rotating cone designed with inner ribs and grooves.

The following detailed description is not limited or intended to be limited to the following preferred embodiment description or illustration. Although every effort has been made to describe the particular embodiments, one skilled in the art may recognize certain changes that can be made in design or shape that may still be in the scope and spirit of the invention as declared in the claims for this invention.

The embodiments listed are intended to be illustrative and should not be deemed limited in their scope. The embodiments are not and should not be deemed to be totally exclusive in their depiction, furthermore, the components that make up this present invention can be used in various combinations and relationships to one another.

The process of making or manufacturing the Tommy Power Paddle can be conducted either by using various power tools or can be completely hand made by a skilled craftsman. The handle, shaft and paddle blade components of this invention can be comprised of natural components such as cypress wood and various other natural woods or a combination of manmade materials. The fixed orifice device housing with the center rotating cone shape device with raised ribs and groove components as well as the multi-blade propeller housing with the multi-blade propeller would more than likely be made using high impact plastics or resins using an ejection-mold process. All of the components used in making this paddle device should be water proof and extremely sturdy for use in all types of outdoor elements.

Please note, in respect to the attached description, it is noted that the size, shape and dimensional relationship between the various components of this invention can vary. Also, consideration for the types of material in the construction of the various components can vary and all equivalent relationships as illustrated in the drawings and described in the text are intended to encompass the embodiment of this invention.

Please note, that one skilled in the art may recognize possible modifications of the various components and embodiments of this present invention, however, the scope and spirit of this present invention is defined in the claims of this present invention.

FIG. 1 refers to an overall front view of the canoe, kayak, paddle board or similar watercraft paddle device. 1*a* refers to the paddle device shaft and 1*b* refers to the paddle device handle. Both of these may be of varying sizes and shapes and made of various material and material compositions, but intended to carry out the scope and idea of the paddle device. 1*c* refers to the paddle blade that can also be made of various sizes and shapes and made of various material and material compositions to facilitate this invention. The fixed housing 2 for the multi-blade propeller is designed to allow the rotation and swiveling action of the inner multi-blade propeller 3. The capability of having the multi-blade propeller 3 to swivel facilitates the relationship of the multi-blade propeller to be more in alignment with the water driving it from the pulling of the paddle device through the water. The lattice type guard 4 allows the multi-blade propeller to be protected and is located on both sides of the paddle blade device. This lattice type guard 4 is designed so as not to restrict the water driving the multi-blade propeller. This also protects the operator of the paddle device from the rotating multi-blade propeller.

The fixed orifice device housings 5, 6 and 7 are also designed to allow the rotation and swiveling action of the center cone shape orifice devices 8, 9 and 10. The larger opening or entrance orifice of the fixed orifice device is on the pulling side of the paddle blade device. The smaller opening or discharge orifice is on the opposite side of the paddle blade, or away from the pulling stroke. This creates water force through the cone shaped orifice with the inner ribs and grooves through the kinetic energy of pulling the paddle device through the water. These center orifice devices 8, 9 and 10 are designed with a center rotating cone shape design with inner ribs and grooves allowing the cone shape inner device to rotate while having the capability of swiveling. The swiveling action of the cone shape inner device allows the center cone shaped orifice device to be more in alignment with the water driving it from the pulling of the paddle device through the water. The center rotating cone shape device with the inner ribs and groves generates increased water pressure as the paddle device is pulled through the water.

Figure 2:
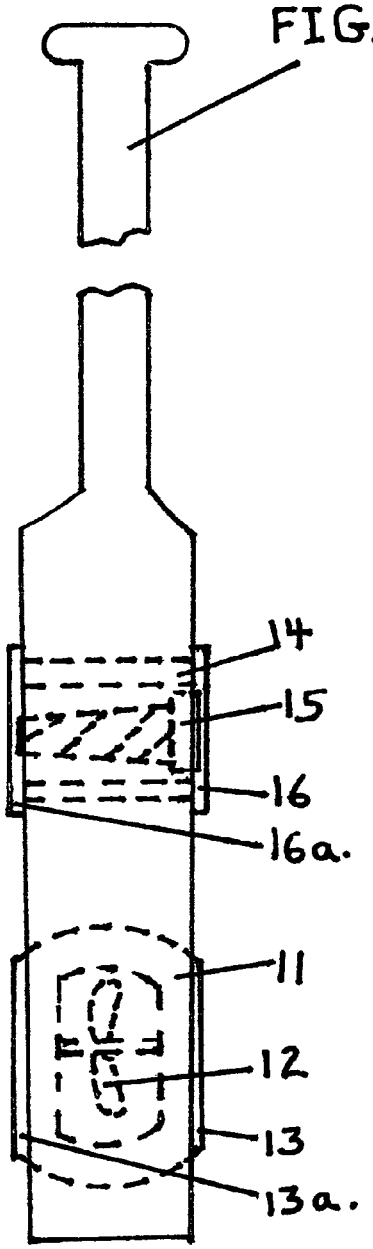
FIG. 2 illustrates a side perspective view of the canoe, kayak, paddle board or similar watercraft paddle blade device with a propeller housing assembly as well as an orifice device with the center rotating cone shape designed with inner ribs and grooves.

FIG. 2 refers to an overall side view of the canoe, kayak, paddle board or similar watercraft paddle device. The fixed housing for the multi-blade propeller 11 is designed to allow the rotation and swiveling action of the inner multi-blade propeller 12. The lattice type guard 13 and 13*a* allows the propeller to be protected and does not restrict the water driving the multi-blade propeller 12. This also protects the operator of the paddle device.

The fixed orifice device housing 14 is designed to allow the swiveling action of the inner orifice device 15 with the center rotating cone shape that has inner ribs and grooves. (Please note, two of the orifices on FIG. 2 are intentionally not shown for clarity.) The lattice type guards, 16 and 16*a* are shown on both sides of the paddle blade device protecting the orifice device housing.

Figure 3:
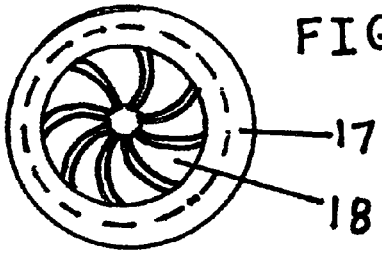
FIG. 3 illustrates an expanded front view of the orifice device with the center rotating cone shape design with inner ribs and grooves.

FIG. 3 refers to an overall enlarged front view of the fixed orifice device housing. The fixed orifice device housing 17 is designed to allow the center rotating cone shape device 18 with raised ribs and grooves to also have a swiveling capability. (The lattice type fixed orifice device guard is intentionally not shown for clarity.)

Figure 4:
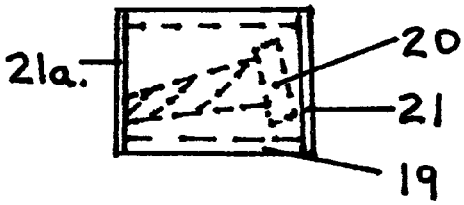
FIG. 4 illustrated an expanded side view of the orifice device with the center rotating cone shape design with inner ribs and grooves depicting the swiveling capability of the center rotating cone shape design with inner ribs and grooves.

FIG. 4 refers to an overall enlarged side view of the fixed orifice device housing with the center rotating cone shape device with raised ribs and grooves. The fixed orifice device housing 19 is designed to allow the rotating cone shape inner device 20 with raised ribs and grooves to also have a swiveling capability. The lattice type fixed orifice device guard is shown as 21 and 21*a* protecting the orifice device.

Figure 5:
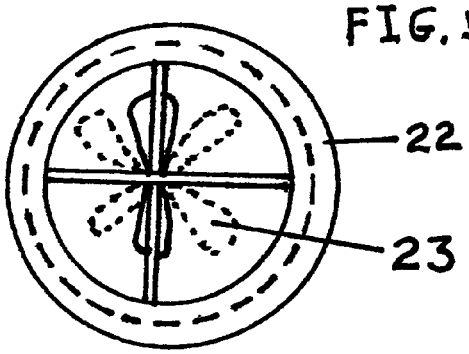
FIG. 5 illustrates an expanded front view of the propeller housing assembly illustrating the swiveling capability of the propeller blade.

FIG. 5 refers to the overall front view of the propeller housing with the inner multi-blade propeller. The multi-blade propeller housing 22 is designed to allow the rotation and swiveling action of the multi-blade propeller 23. (The lattice type multi-blade propeller guard is intentionally not shown for clarity.)

Figure 6:
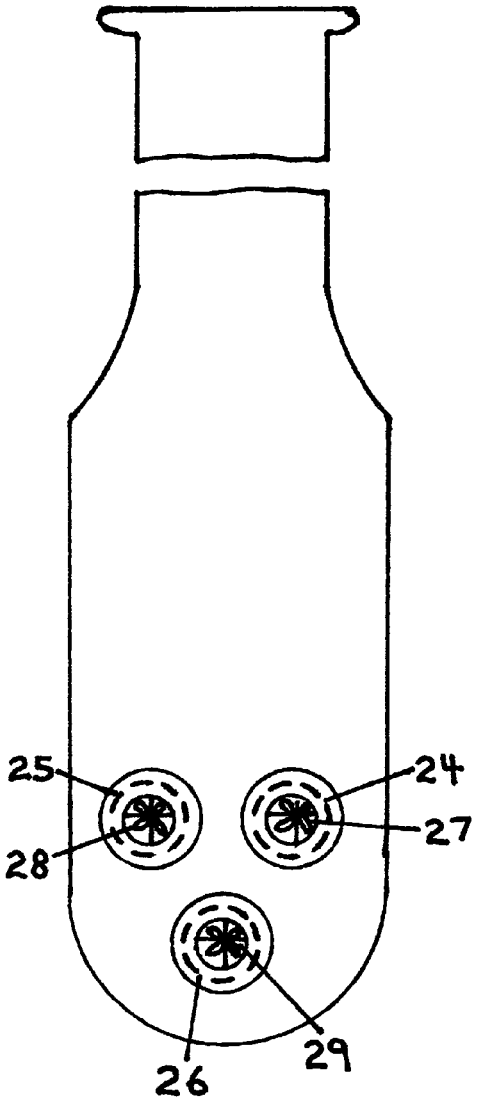
FIG. 6 illustrates a front view of the canoe, kayak, paddle board or similar watercraft paddle blade with three propeller housing assemblies with multi-blade propellers.

FIG. 6 refers to the overall front view of the canoe, kayak, paddle board or similar watercraft paddle device. This figure shows three multi-blade propeller housings referenced as 24, 25 and 26 with the multi-blade propeller referenced as 27, 28, and 29. (The lattice type fixed orifice device guards are intentionally not shown for clarity.)

Figure 7:
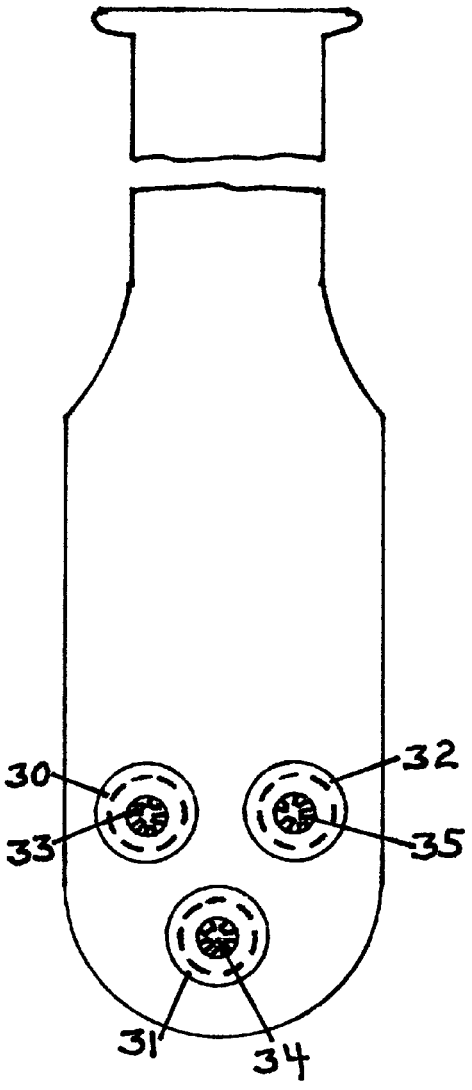
FIG. 7 illustrates a front view of the canoe, kayak, paddle board or similar watercraft paddle blade with three cone shaped orifice devices with the center rotating cone shape design with inner ribs and grooves.

FIG. 7 refers to an overall front view of the canoe, kayak, paddle board or similar watercraft paddle device. This figure shows three cone like orifice device housings, 30, 31 and 32 designed to allow the rotation and swiveling action of the center cone like orifice device with raised ribs and grooves referenced as 33, 34 and 35. (The lattice type fixed orifice device guards are intentionally not shown for clarity.)

I claim:

1. A paddle for maneuvering or powering a watercraft comprising:

a shaft having a first end and a second end;

a paddle blade having a proximal end and a distal end and coupled to the second end of the shaft; the paddle blade comprising;

one or more multi-blade propeller housings mounted therein, each having a multi-blade propeller; each propeller housing being open on both sides of the paddle blade;

one or more orifice device housings through the paddle blade;

a device rotatably mounted within each orifice device housing, each device comprising a cone shaped through hole defining large and small openings, inner ribs and grooves; the large opening of the cone shaped device being on the face side of the paddle blade and the small opening, or discharge side, is on the opposite side of the paddle blade;

wherein a pulling stroke of the paddle forces water through the propeller and orifice device housings to rotate the respective propeller or device therein, thus increasing water pressure-through each propeller or device to reduce the physical effort of pulling the paddle through the water and wherein the pulling stroke provides the sole power for rotating the one or more propeller via kinetic energy.

2. The paddle of claim 1 where each multi-blade propeller is oriented so as the thrust is away from the pulling stroke of the paddle blade such that rushing water generated by the pulling stroke forces each multi-blade propeller and device to rotate forcing water in the direction of the pulling stroke or in the direction of the paddle movement to help propel the watercraft forward.

3. The paddle of claim 1 where each multi-blade propeller is designed to swivel within each multi-blade housing so as to keep each multi-blade propeller more in line with a pulling force of water generating the propeller blade rotation.

4. The paddle of claim 1 where each multi-blade propeller is protected by a lattice guard on both sides of the paddle blade.

5. The paddle of claim 1 where the rotating cone shaped device swivels relative to the paddle blade so as to keep water force generated by the pulling stroke of the paddle in line with a pulling force of the water.

6. The paddle of claim 1 where the paddle can be used in a reverse fashion by rotating the paddle blade up to 180 degrees so as to be used when navigating a watercraft with a water current in order to help stabilize the watercraft by using the force of the current against the blade to aid in controlling the watercraft.

7. The paddle of claim 1 where the paddle is a kayak paddle with a paddle blade on each of the shaft ends.

* * * * *